United States Patent [19]

LeFevre

[11] Patent Number: 4,785,972

[45] Date of Patent: Nov. 22, 1988

[54] PRESSURE GENERATING SYSTEM FOR A DISPOSABLE CONTAINER

[75] Inventor: Paul H. LeFevre, Golden, Colo.

[73] Assignee: Adolph Coors Company, Golden, Colo.

[21] Appl. No.: 73,756

[22] Filed: Jul. 14, 1987

[51] Int. Cl.[4] ..... B65D 83/14

[52] U.S. Cl. ..... 222/1; 222/386.5

[58] Field of Search ..... 222/386.5, 1, 399, 396; 424/466, 156, 43, 44, 472, 473; 44/3.3, 3.6, 3.8; 423/438; 60/721, 723

[56] References Cited

U.S. PATENT DOCUMENTS

| | | | |
|---|---|---|---|
| 3,718,236 | 2/1973 | Reyner et al. | 222/386.5 |
| 3,861,404 | 1/1975 | Changani | 264/D13 X |
| 4,360,131 | 11/1982 | Reyner | 222/386.5 |
| 4,376,500 | 3/1983 | Banks et al. | 222/386.5 |
| 4,478,044 | 10/1984 | Magid | 222/386.5 X |
| 4,513,884 | 4/1985 | Magid | 222/386.5 X |
| 4,679,706 | 7/1987 | Magid et al. | 222/386.5 X |

*Primary Examiner*—Joseph J. Rolla
*Assistant Examiner*—Nils E. Pedersen
*Attorney, Agent, or Firm*—Klaas & Law

[57] ABSTRACT

A self-generating gas pressure apparatus such as an expandable closed pouch for placement within a container from which a fluid therein is to be dispensed under pressure. The apparatus has a plurality of internal compartments formed by pressure-rupturable seals and containing respective chemical compounds which when mixed upon adjacent-compartment seal rupture produce a gas. At least one of two adjacently-housed chemical compounds has in addition thereto a nucleating agent such as diatomaceous earth which acts to more rapidly force gas generated in the reaction of the adjacently-housed chemical compounds out of solution and thereby provide an operative pressure to the apparatus more quickly.

36 Claims, 3 Drawing Sheets

PRESSURE GENERATING SYSTEM FOR A DISPOSABLE CONTAINER

BACKGROUND OF THE INVENTION

This invention relates generally to a self-generating gas pressure apparatus such as an expandable pouch means positionable in a container containing a fluid so as to provide pressure on the fluid so that it can be dispensed from the container, and in particular to a method for gas generation employing gas-producing chemical reactants provided with a nucleating agent to enhance the speed and maintenance of gas production and resultant pressure within the apparatus.

The use of self-generating gas pressure apparatus in general within a container from which a fluid is to be dispensed under pressure is well-known in the art. U.S. Pat. Nos. 4,360,131, 4,376,500, 4,478,044 and 4,513,884, for example, describe various gas-generating pressure apparatus. Typically, an expandable closed vessel such as a pouch means having a plurality of internal compartments is employed, with the compartments having interfacing barriers or individualized walls formed by seals which are rupturable under pressure. Within adjacent compartments, for example, one such compartment will contain a first chemical compound and the second compartment will contain a second chemical compound. The particular compounds are chosen from among those which react with each other to form a gas. Thus, for example, one compartment may contain citric acid, while the other compartment contains sodium bicarbonate. When these two compounds mix with each other, they react to produce carbon dioxide. To accomplish such mixing in the expandable vessel, a trigger reaction is permitted to occur which subsequently causes the rupture of the seal which interfaces between the two adjacent compartments. This results in the mixture and reaction of the two compounds to produce a gas which expands the vessel to thereby apply pressure on the fluid within the container in which the expandable vessel is housed. A novel self-generating pressure applying means is taught in co-pending and commonly-assigned U.S. patent application Ser. No. 34,900, filed Apr. 6, 1987, incorporated herein by reference.

While gas pressure generation occurs as above described and is generally adequate as long as sufficient time passes between individual dispensing procedures to thereby achieve pressure regeneration from continued chemical reaction, such generation may not be rapid enough or sufficiently uniform to provide optimum pressure to the fluid to be dispensed from the containers during continued dispensing, resulting in a slow fluid flow from the container as the dispensing procedure continues. Accordingly, it is a primary object of the present invention to provide a self-generating gas pressure apparatus wherein gas formation occurs relatively rapidly and uniformly. Another object of the present invention is to provide apparatus wherein chemical compounds which react with each other to produce gas react in the presence of a nucleating agent. Yet another object of the present invention is to provide apparatus wherein caking of the nucleating agent employed as well as production of a stable foam during reaction of the chemical compounds is retarded. These and other objects of the present invention will become apparent throughout the description thereof.

SUMMARY OF THE INVENTION

The subject of the present invention comprises a self-generating gas pressure apparatus, such as an expandable closed vessel as exemplified by a pouch means, for placement within a container from which a fluid therein is to be dispensed under pressure. The apparatus comprises a plurality of internal, sealed, respectively adjacent compartments formed by respective interfacing seal means which are rupturable under pressure and contain respective chemical compounds which when mixed upon the rupture of respective interfacing seal means produce a gas. Within at least two adjacent internal compartments are respectively housed a first chemical compound in aqueous solution and a second chemical compound in aqueous solution which, when mixed together, produce a gas. Two preferred reactants are citric acid and sodium bicarbonate which produce carbon dioxide. At least one of the solutions additionally contains an insoluble nucleating agent physically characterized as large surface-area particles preferably having a plurality of sharp edges. Diatomaceous earth exemplifies such particles. Preferably, an anti-caking agent and an anti-foam agent are also included in the solution containing the nucleating agent. Upon rupture of the seal means between the two adjacent compartments, one large compartment is formed and the first and second chemical compounds mix with each other to produce the gas which expands the apparatus and thereby applies pressure to the fluid within the container wherein the apparatus is housed so that this fluid can be dispensed under pressure. Inclusion of the nucleating agent forces supersaturated gas out of the liquid phase and into the gas phase more quickly for more rapid and maintained equilibrium conditions between the chemical compound reactants. Additionally, of course, the more rapid gas pressure production will act to rupture subsequent seals to adjacent reactant-containing compartments more quickly to thereby speed additional reactant mixing and consequent production of more gas pressure more quickly. In this manner a greater pressure is generated and maintained more quickly to aid in effective continuous pressurized dispensing procedures.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
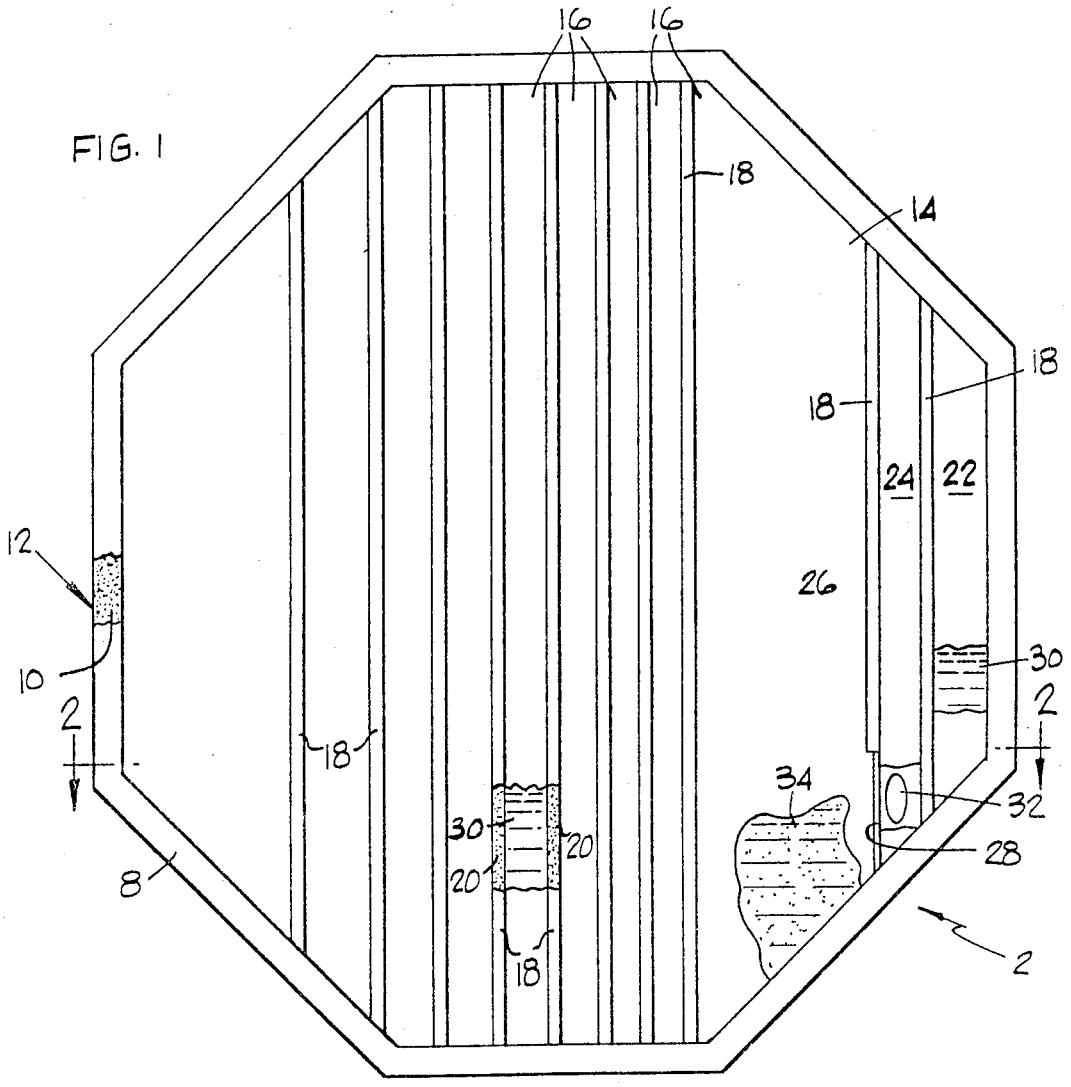
FIG. 1 is a front elevational view with portions broken away illustrating an expandable pouch means and the components of a gas generating system.
Figure 2:
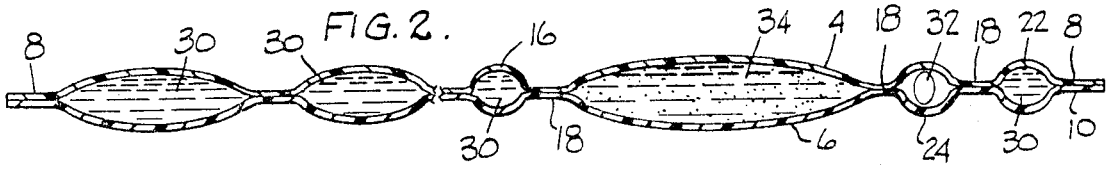
FIG. 2 is a cross-sectional view taken on the line 2—2 of FIG. 1.
Figure 3:
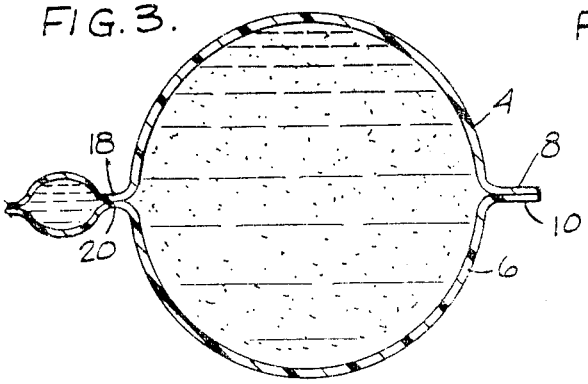
FIG. 3 is a cross-sectional view of a partially expanded expandable pouch means.

An expandable pouch means 2 of the presently preferred embodiment is illustrated in FIGS. 1–3 and comprises two relatively flat sheets 4 and 6 of a flexible plastic material in superposed relationship and made from a gas and liquid impermeable material such as a composite material of an outside layer of a polyester with an inside coating of PVDC, a layer of polyethylene and a layer of an ionomer resin, such as that marketed by Dupont under the trade designation SURLYN. Each of the flat sheets 4 and 6 is octagonal in shape having a length greater than its width and with peripheral edge portions 8 and 10 permanently joined together by a permanent sealing means 12 formed by heat sealing at a temperature of about 300° F. for 0.5 second. The expandable pouch 2 is formed into a first compartment 14 and a plurality of other compartments 16 by a plurality of lengthwise extending strips 18 which join together opposed portions of the flat sheets 4 and 6 using a semipermanent pressure-rupturable sealing means 20 formed by heat sealing at a temperature of about 250° F. for 0.5 second. If the flat sheets 4 and 6 are formed from different plastic materials, the temperature and time would be adjusted as required to obtain the desired type of seal. Also, if desirable, a suitable adhesive could be used to obtain the desired results.

The normal operation of an expandable pouch means 2 uses some delaying system so that the chemical reaction can be started and still allow for sufficient time for expandable pouch means 2 to be inserted into the container means and suitable sealing and dispensing means applied to the container means. The delaying system for this invention is illustrated in FIG. 1 wherein the first compartment is sub-divided to three sub-compartments 22, 24 and 26. The sub-compartment 22 is formed by a lengthwise extending strip 18, as described above, extending parallel to the next adjacent permanent lengthwise extending sealed edge portions 8 and 10. The sub-compartments 24 and 26 are formed by a lengthwise extending strip 18, as described above, extending parallel to and spaced inwardly from the strip 18 forming sub-compartment 22. The lower portion 28 of the strip 18 forming the sub-compartments 24 and 26 has a reduced width for a purpose described below. A quantity of a first chemical compound in aqueous solution, here a 50% citric acid solution 30, is contained in the sub-compartment 22. A tablet 32 comprising the second compound, here a concentrated sodium bicarbonate tablet, is contained in the sub-compartment 24. An aqueous solution 34 of sodium bicarbonate additionally containing a nucleating agent comprising diatomaceous earth, a surfactant, and an anti-foam agent is contained in the sub-compartment 26. The other compartments 16 each contain a quantity of the citric acid solution 30. It is to be understood, of course, that other or additional chemical reactants can be employed as would be recognized by the skilled artisan to produce a desired gas end-product.

In operation, a force is applied to the sub-compartment 22 by hand prior to insertion of the pouch means 2 into the container means to rupture the strip 18 so that the citric acid solution 30 flows into sub-compartment 24 to contact the sodium bicarbonate tablet 32, and begins to react therewith to generate carbon dioxide gas. This reaction with the tablet 32 proceeds at a rate to provide the above-described delaying system to allow the expandable pouch means 2 to be inserted into the container means and suitable sealing and dispensing means applied to the container means. The generation of the carbon dioxide gas forms a pressurized force forcing the strip 18 between the sub-compartment 24 and the sub-compartment 26 to rupture at the weakened reduced width 28 to combine the sub-compartments 24 and 26. This permits the citric acid solution 30 to flow into sub-compartment 26 and into contact with the sodium bicarbonate solution 34 and further react to continue the generation of carbon dioxide gas. As the generation of the carbon dioxide gas continues, the pressure within the first compartment 14 is increased so as to expand the portions of the flat sheets 4 and 6 forming the first compartment 14. The dispensing of fluid from the container means, as described below, will provide space for further expansion of the expandable pouch means 2. When the limit of the volume of the first compartment 14 is reached, further generation of carbon dioxide gas therein will result in a force being applied to the strip 18 between the first compartment 14 and the next adjacent other compartment 16 so as to rupture such strip 18. The citric acid solution 30 in the next adjacent other compartment 16 will contact the sodium bicarbonate solution 34 to continue the generation of carbon dioxide gas. This sequence will continue until the expandable pouch means 2 has been substantially completely expanded. The total amount of citric acid solution 30 in the entire pouch means 2 here exemplified is 81.1 ml. As would be recognized by the skilled artisan, reactant quantities are, of course, chosen according to the volume of the pouch means 2 as well as the magnitude of chemical reaction desired.

Figure 4:
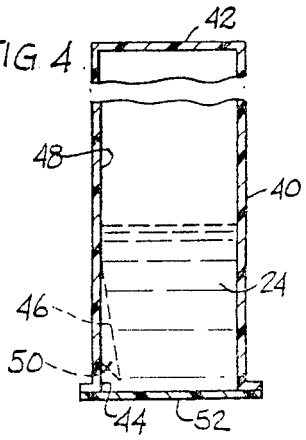
FIG. 4 is a cross-sectional view of a container for holding one component of a gas generating system.

Another embodiment for the provision of the citric acid solution 30 in the first compartment 14 is illustrated in FIG. 4 and is particularly useful when the fluid in the container means is a carbonated beverage, such as beer. A substantially rigid container 40, which in the preferred embodiment is plastic, has a closed end 42 and an open end 44. The container 40 is illustrated as being a tube but it is to be understood that it can be of any desired geometrical configuration. A barb 46 is secured to the inner surface 48 of the container 40 with its pointed end 50 facing and relatively close to the open end 44. A quantity of the citric acid solution 30 is placed in the container 40 and the open end 44 is sealed by a flexible membrane 52. The strips 18 forming the sub-compartments 22, 24 and 26 are not used in this modification so that the first compartment 14 is one unitary compartment. The filled container 40 is contained in the first compartment 14 with the sodium bicarbonate solution 34. After the expandable pouch means 2 has been inserted into the container means filled with a carbonated beverage, as described below, the pressures generated by the carbonated beverage in the container means will exert a pressure on the flexible membrane 52 moving it into contact with the pointed end 50 to rupture the flexible membrane 52 and permit the citric acid solution 30 to flow into the sodium bicarbonate solution 34 in first compartment 14 to start the carbon dioxide gas generating system.

Figure 5:
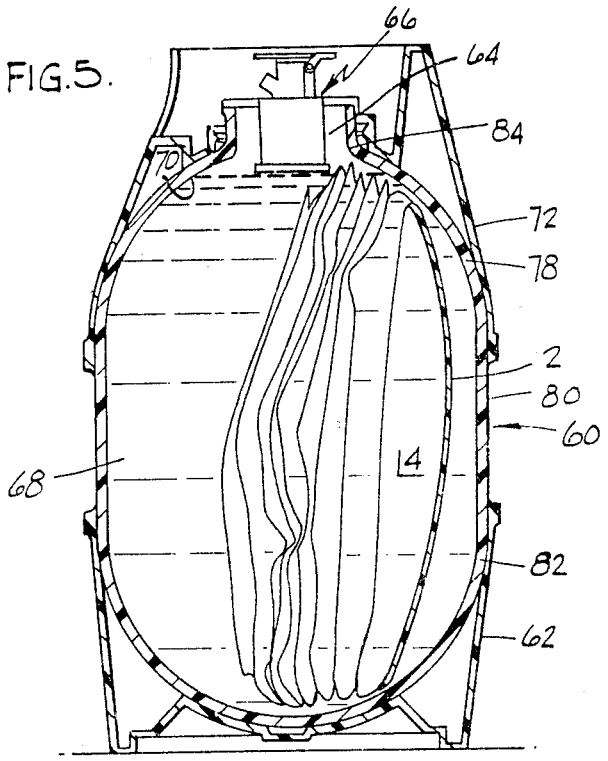
FIG. 5 is a cross-sectional view, except for the dispensing means, illustrating a container means and its supporting structure in an upright position for shipping and commercial storage and a partially expanded expandable pouch means.
Figure 6:
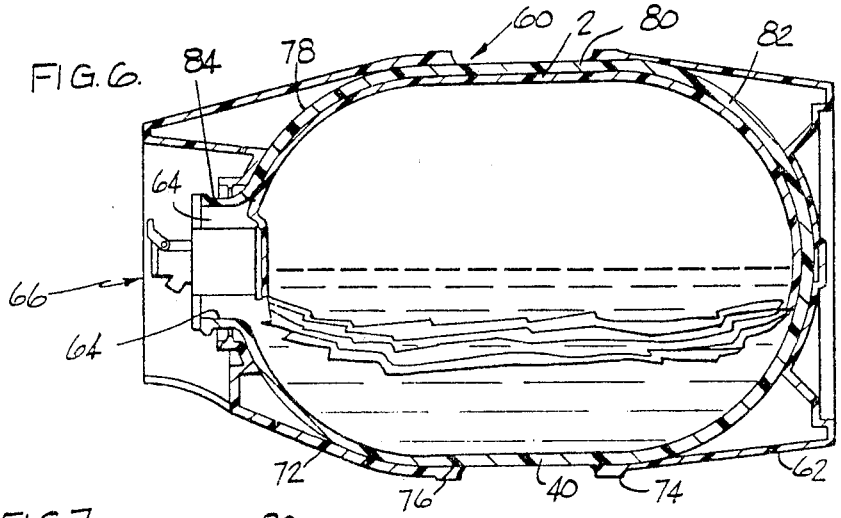
FIG. 6 is a view similar to FIG. 5 but with the container means in a dispensing position and after more than half of the fluid has been dispensed.
Figure 7:
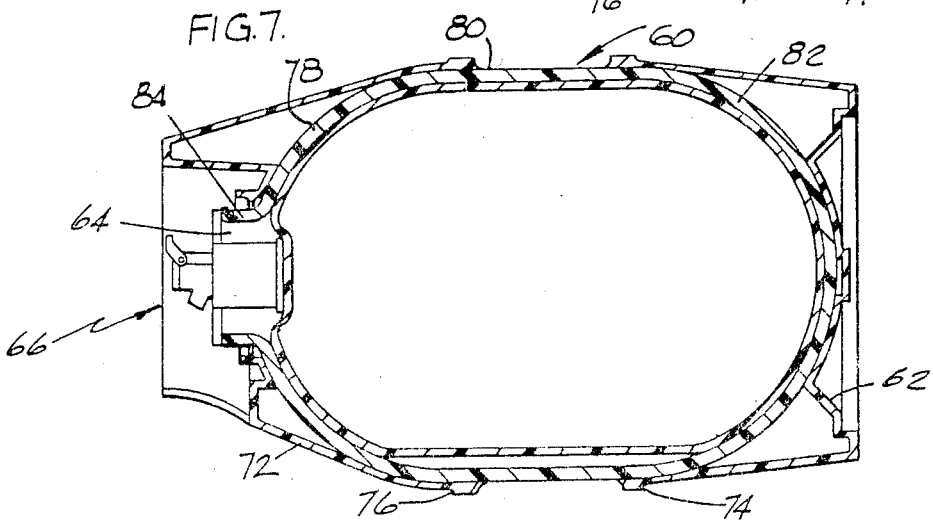
FIG. 7 is a view similar to FIG. 5 but after substantially all of the fluid has been dispensed.

The location of the expandable pouch means 2 in a container means 60 is illustrated in FIGS. 5–7. In FIG. 5, the container means 60 is supported in the upright position for shipping and commercial storage by a support member 62. The expandable pouch means 2 has a length substantially greater than the longitudinal extent of the container means 60 and a width substantially greater than the diameter of the container means 60. Therefore, in order to insert the expandable pouch means 2 through an opening 64 in the container means 60, it is necessary to apply a force in a widthwise direction to compact the expandable pouch means 2 in that direction so that its cross-sectional configuration is less than the cross-sectional configuration of the opening 64. Also, as the expandable pouch means 2 is inserted into the container means 60, it is necessary to apply a force in the lengthwise direction to push the expandable pouch means 2 into the container means 60. This results in a crumpling of the expandable pouch means 2 in the lengthwise direction. Since the material in the expandable pouch means 2 has little tendency to resile, it will remain crumpled while a dispensing means 66 for dispensing portions of the material in the container means 60 is assembled in the opening 64. In the preferred embodiment, the fluid 68, such as a carbonated beverage such as beer, is in the container means 60 prior to the insertion of the expandable pouch means 2. If desired, the expandable pouch means 2 can be inserted into the container means 60 prior to the filling of it with the fluid. The fluid level 70 is slightly below the dispensing means 66. The strip 18 forming sub-compartment 22 is ruptured prior to the insertion of the expandable pouch means 2 into the container means 60 so that the gas generating system is in operation, as described above, and the first compartment 14 has been at least partially expanded in the illustration in FIG. 5. The container means 60 is illustrated in the fluid dispensable position in FIGS. 6 and 7. Another support member 72 has been previously secured to the container means 60. The support member 62 and the support member 72 have planar surfaces 74 and 76 for supporting the container means 60 on a generally horizontal surface, such as a shelf of a home refrigerator. The planar surfaces 74 and 76 also function to maintain the container means 60 in such fluid dispensable position. While it is highly preferred to use the horizontal dispensing position, it is understood that the pressure in the container means provided by the expandable pouch means would permit dispensing in other positions, some of which may require different types of dispensing means. In FIG. 6, more than half of the fluid has been dispensed from the container means 60. The first compartment 14 and several of the next adjacent other compartments 16 have been expanded, as described above, to form a combined compartment which is located adjacent to the upper longitudinally extending portion of the container means 60. In FIG. 7, the expandable pouch means 2 is substantially fully expanded and is substantially completely in contact with the inner surface of the container means 60 except for the portion defining the opening 64. After substantially all the fluid 68 has been dispensed from the container means 60, a pressure relieving device (not shown) in the dispensing means 66 is actuated and the carbon dioxide gas in the expanded pouch means 2 is removed through the dispensing means 66 so that the container means 60 and the expandable pouch means 2 are substantially at atmospheric pressure and the container means 60 can be safely placed in the trash.

When the expandable pouch means 2 is being inserted into the container means 60, the strips 18 are generally parallel with the longitudinal axis of container means 60 to thereby achieve optimum positioning for fluid dispensing under pressure. As explained above, the relative length of the expandable pouch means 2 causes it to be crumpled as it is inserted into the container means 60. However, the strips 18 still extend generally in the same direction as the longitudinal axis of the container means 60. As fluid is dispensed from the container means 60 and more of the other compartments 16 are expanded, the expanded portion of the expandable pouch means 2 gradually moves into a position wherein its longitudinal axis is parallel to the longitudinal axis of the container means 60, as illustrated in FIG. 6. When the expandable pouch means 2 is fully expanded, as illustrated in FIG. 7, the longitudinal axes of the expandable pouch means 2 and the container means 60 will substantially coincide.

As illustrated in FIGS. 5–7, the container means 60 comprises a blown hollow integral plastic container means made of one piece of integrally molded plastic material, such as polyethylene terephthalate (PET), and having a hemispherical top portion 78, an annular cylindrical central portion 80, a hemispherical bottom portion 82 and a neck portion 84 defining the opening 64. The container means 60 is large enough to hold 288 fluid ounces of a beverage.

The expandable pouch means 2 may be of any size and shape so as to be commensurate with the size and shape of the container means 60 with which it is to be used. Also, the expandable pouch means 2 may be used to dispense any kind of material from the container means as is customary in this art. However, in the preferred embodiment of the invention, the expandable pouch means 2 is designed for applying pressure to a quantity of beer equal to 288 fluid ounces or 2.25 gallons in a container means 60. The expandable pouch means 2 exemplified is designed for such a container means wherein the container means 60 has an overall length along its longitudinal axis of about 15.5 inches, an external diameter of the cylindrical central portion 70 of about 9.0 inches, and an average wall thickness of about 0.030 inches. The expandable pouch means 2 has an overall length of about 17 inches and an overall width of about 15.5 inches and has nine compartments formed therein.

The first compartment 14 will expand to cause the rupturable seam strip 18 between it and the next adjacent other compartment to rupture. The first compartment 14 or sub-compartment 26 contains 100 grams of sodium bicarbonate, which is more than the stochiometric amount necessary to react with the citric acid to produce the required pressurizing gas, combined with 150 ml water, 10 g diatomaceous earth (Aqua Cell, manufactured by Manville Corporation), 5 ml surfactant (Dowfax 2Al , manufactured by Dow Chemical Co.), and 1 ml anti-foam agent (Dow-Corning Antifoam FG 10, manufactured by Dow-Corning Co.). While diatomaceous earth is a preferred nucleating agent, it is to be understood that other or additional nucleating agents can be employed so long as they meet the above-recited physical characteristics of large surface area and sharp edges. A surfactant is preferably included to inhibit caking of the nucleating agent, and can be chosen from any appropriate synthetic detergent or dispersing agent as would be recognized by the skilled artisan. An anti-foam agent is preferably included to inhibit filling of the pouch means 2 with stable foam produced by the surfactant, and likewise can be chosen from appropriate and recognized anti-foam agents. It is preferred that the chemical compound reactants, nucleating agent, surfactant, and anti-foam agent all be acceptable for food contact or food grade if the fluid to be disposed from the container in which the pouch means 2 is placed is to be drunk. This precaution is taken in the event the pouch means 2 accidently ruptures and the contents therein become mixed with the fluid to be dispensed and consumed.

Figure 8:
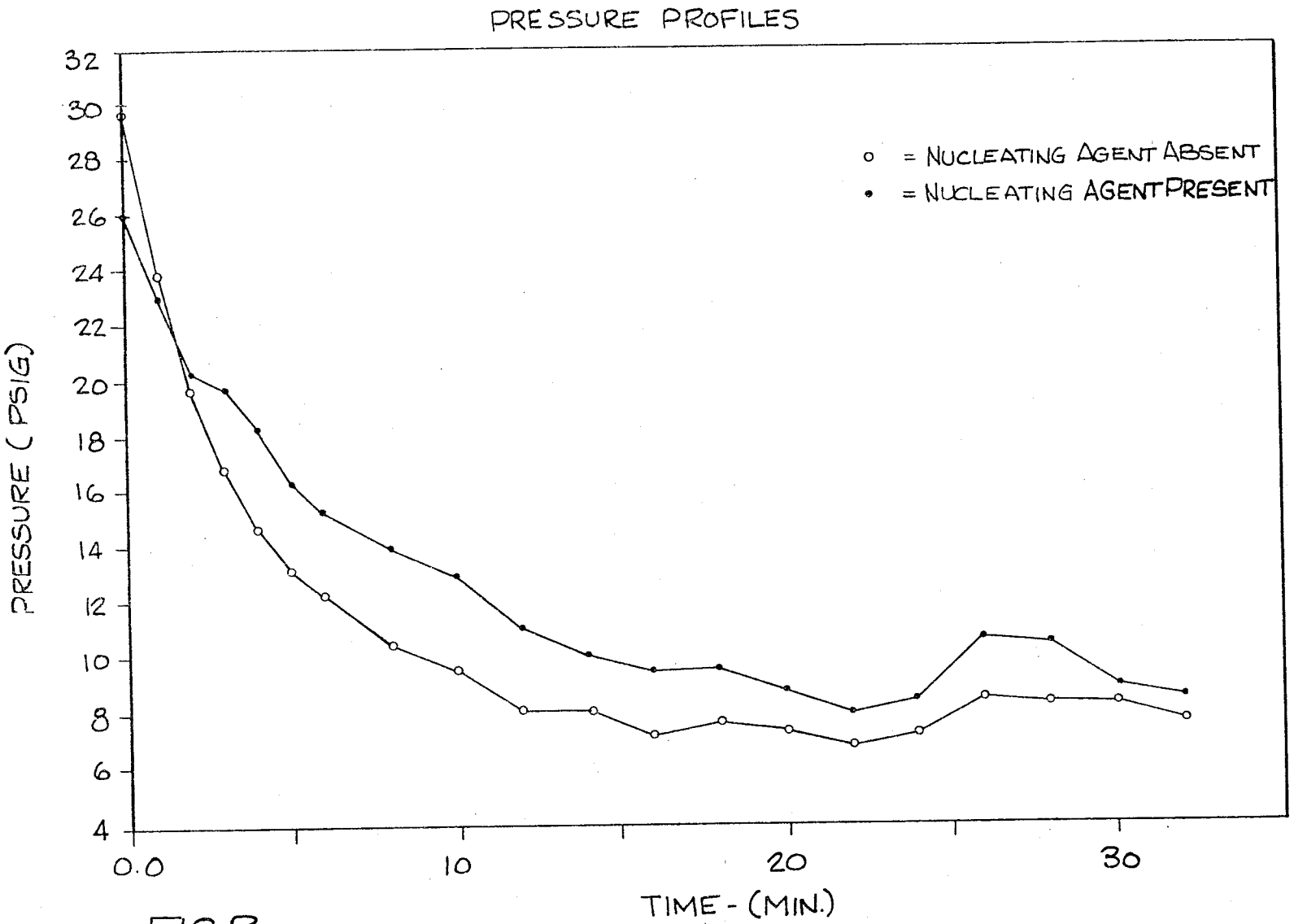
FIG. 8 is a graph which illustrates pressure generation profiles of gas-producing chemical reactants with and without a nucleating agent being present.

FIG. 8 graphically displays the average pressures present within the container 60 from several comparison tests between the presence and absence of diatomaceous earth, surfactant and anti-foam agent in the sodium bicarbonate solution 34 of the pouch means 2 within the container 60 while beer is being essentially continuously dispensed from the container at the rate of about 250 ml per minute. All other conditions were held constant. As is evident from these results, the presence of the nucleating agent performed to maintain a higher pressure beginning at about two minutes into the dispensing procedure and contained for the duration of the time span exemplified.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A self-generating gas pressure apparatus for placement within a container from which a fluid in the container is to be dispensed under pressure exerted on the fluid by the gas pressure apparatus and wherein said gas pressure apparatus comprises a closed expandable vessel having a plurality of individual compartments formed by respective pressure-rupturable seal means therebetween, said compartments containing respective chemical compounds which when mixed upon the rupture of respective interfacing seal means produce a gas, and wherein at least two adjacent compartments respectively contain a first chemical compound aqueous solution and a second chemical compound aqueous solution which, when mixed upon the rupture of the seal means between said adjacent compartments, react with each other to produce a gas, and wherein an insoluble nucleating agent is included with at least one of the first and second chemical compound aqueous solutions.

2. The invention according to claim 1 wherein the first chemical compound is sodium bicarbonate and the second chemical compound is citric acid.

3. The invention according to claim 2 wherein the nucleating agent is included with the sodium bicarbonate.

4. The invention according to claim 1, 2, or 3 wherein the nucleating agent comprises diatomaceous earth.

5. The invention according to claim 4 wherein the nucleating agent has in addition thereto an anti-caking agent and an anti-foam agent.

6. The invention according to claim 1 wherein the nucleating agent has in addition thereto an anti-caking agent and an anti-foam agent.

7. A self-generating gas pressure apparatus which is inserted into a container means having material contained therein so as to apply a pressure on the material so that is may be readily dispensed from the container means comprising:

an expandable pouch means comprising at least two relatively flat sheets of a gas and liquid impermeable material in superposed relationship and having a length and a width;

said expandable pouch means having a plurality of linearly extending edge portions;

permanent sealing means for joining said superposed flat sheets along said edge portions so as to form an enclosed space therebetween;

compartment forming means between said superposed flat sheets for forming a plurality of compartments in said expandable pouch means;

said compartment forming means comprising lengthwise extending strips of a semipermanent pressure-rupturable sealing means securing together superposed portions of said superposed flat sheets;

said semipermanent rupturable sealing means permitting separation of said superposed flat sheets in response to pressure applied thereto;

gas pressure generating means in one of said compartments to increase the gas pressure in said one compartment so that the portions of said superposed flat sheets forming said one compartment are forced apart to apply pressure to separate said semipermanent rupturable sealing means between said one compartment and the next adjacent compartment so that said one compartment and said next adjacent compartment are joined together to form a combined compartment;

gas pressure generating means in said next adjacent compartment to continue the generation of gas pressure to force apart the portions of said superposed sheets forming said combined compartment as said material is dispensed from said container means; and a nucleating agent included with at least a portion of said gas pressure generating means.

8. The invention according to claim 7 wherein:

said compartments are of different sizes.

9. The invention according to claim 7 wherein said gas pressure generating means in said one compartment comprises:

two components of a chemical gas generating system; and at least one of said components being confined within an enclosure having rupturable means so that said enclosure may be ruptured allowing said one component to react with the other component to commence generating a gas.

10. The invention according to claim 9 and further comprising:

gas pressure generating means in all of the others of said compartments.

11. The invention according to claim 10 wherein said gas pressure generating means in all of the others of said compartments comprises:

one of said two components.

12. The invention according to claim 11 wherein:

said expandable pouch means being located within a container means having a gas pressure generating beverage contained therein;

one component of said two component chemical gas generating system in said first compartment comprises a liquid;

said enclosure comprising a rigid container having at least one open end located in said first compartment;

a flexible membrane covering said open end and in sealed engagement therewith so as to contain a quantity of said one component in said container; and membrane rupturing means in said container and located next to said open end so as to pierce said flexible membrane when said flexible membrane is forced into said container by pressure forces generated within said container so as to release said liquid one component into said first compartment.

13. The invention according to claim 12 and further comprising:

said container having an inner surface; and said membrane rupturing means comprises a pointed barb secured to said inner surface with the point of said pointed barb facing said flexible membrane.

14. The invention according to claim 7 wherein said gas generating means in said one compartment comprises:

lengthwise extending strips of a semipermanent rupturable sealing means for dividing said first compartment into at least three sub-compartments;

one component of a two component chemical gas generating system contained within a first sub-compartment;

a second component of said two component chemical gas generating system contained within a second sub-compartment next adjacent to said first sub-compartment so that when said lengthwise strip between said first and second sub-compartments is ruptured, said first and second components will begin to react to produce a gas pressure therein; and a quantity of said second component in a third sub-compartment next adjacent to said second sub-compartment to react with said one compartment when said first and second components in said combined first and second sub-compartments have reacted to produce sufficient gases to provide a pressure to rupture said lengthwise strip between said second and third sub-compartments to continue the generation of gas.

15. The invention according to claim 14 wherein:

said lengthwise strip between said second and third sub-compartments having a weakened portion to facilitate rupturing thereof.

16. The invention according to claim 7 wherein the nucleating agent comprises diatomaceous earth.

17. The invention according to claim 7 or 16 wherein the nucleating agent has in addition thereto an anti-caking agent and an anti-foam agent.

18. A self-pressurizing dispensing container means for beverages such as beer or a soft drink of the type having a container means, a beverage dispensing means mounted on the container means, a beverage within the container means and a self-generating gas pressure apparatus within the container means for applying pressure on the beverage comprising:

a hollow plastic container means made of one piece of integrally molded plastic material for holding a beverage to be selectively dispensed therefrom when located in a dispensing position;

beverage dispensing means mounted on said container means;

said container means having an elongated central generally cylindrical wall portion, an integral generally hemispherical closed first end wall portion, and an integral generally hemispherical second end wall portion having a central longitudinally extending neck portion with a relatively large diameter central opening of sufficient size for filling said container means with a beverage and for inserting said gas pressure apparatus and having means for securing said dispensing means thereto and having a longitudinal axis extending through said central opening;

support means fixedly attached to said container means supporting and maintaining said container means in said dispensing position;

self-generating gas pressure apparatus in said container means comprising:

an expandable pouch means comprising at least two relatively flat sheets of a gas and liquid impermeable material in superposed relationship and having a length and a width;

said expandable pouch means having a plurality of linearly extending edge portions;

permanent sealing means for joining said superposed flat sheets along said edge portions so as to form an enclosed space therebetween;

compartment forming means between said superposed flat sheets for forming a plurality of compartments in said expandable pouch means;

said compartment forming means comprising lengthwise extending strips of a semipermanent rupturable sealing means securing together superposed portions of said superposed flat sheet;

said semipermanent rupturable sealing means permitting separation of said superposed flat sheets in response to pressure applied thereto;

gas pressure generating means in one of said compartments to increase the gas pressure in said one compartment so that the portions of said superposed flat sheets forming said one compartment are forced apart to apply pressure to separate said semipermanent rupturable sealing means between said one compartment and the next adjacent compartment so that said one compartment and said next adjacent compartment are joined together to form a combined compartment;

gas pressure generating means in said next adjacent compartment to continue the generation of gas pressure to force apart the portions of said superposed sheets forming said combined compartment as said beverage is dispensed from said container means;

a nucleating agent included with at least a portion of said gas pressure generating means; and said expandable pouch means being located within said container means so that said lengthwise extending strips extend generally in the same direction as said longitudinal axis of said container means.

19. The invention according to claim 18 wherein:

said compartments of the pouch means are of different sizes.

20. The invention according to claim 19 wherein said gas pressure generating means in said one compartment comprises:

two components of a chemical gas generating system; and at least one of said components being confined within an enclosure having rupturable means so that said enclosure may be ruptured allowing said one component to react with the other component to commence generating a gas.

21. The invention according to claim 20 and further comprising:

gas pressure generating means in all of the others of said compartments.

22. The invention according to claim 21 wherein said gas pressure generating means in all of the others of said compartments comprises:

one of said two components.

23. The invention according to claim 22 and further comprising:

said combined compartment of said expandable pouch means being located adjacent to the upper longitudinally extending portion of said container means when in its dispensing position.

24. The invention according to claim 22 wherein:

said beverage in said container means is a gas pressure generating beverage;

one component of said two component chemical gas generating system in said first compartment comprises a liquid;

said enclosure comprising a rigid container having at least one open end located in said first compartment;

a flexible membrane covering said open end so as to contain a quantity of said one component in said container; and membrane rupturing means in said container and located next to said open end so as to pierce said flexible membrane when said flexible membrane is forced into said container by pressure forces generated within said container means so as to release said liquid one component into said first compartment.

25. The invention according to claim 24 and further comprising:

said container having an inner surface; and said membrane rupturing means comprises a pointed barb secured to said inner surface with the point of said pointed barb facing said flexible membrane.

26. The invention according to claim 25 wherein:

said container means has a volume great enough to contain at least 288 ounces of beverage therein; and said expandable pouch means maintains a pressure within said container means of between about 18 and 25 psig.

27. The invention according to claim 18 wherein said gas generating means in said one compartment comprises:

lengthwise extending strips of a semipermanent rupturable sealing means for dividing said first compartment into at least three sub-compartments;

one component of a two component chemical gas generating system contained within a first sub-compartment;

a second component of said two component chemical gas generating system contained within a second sub-compartment next adjacent to said first sub-compartment so that when said lengthwise strip between said first and second sub-compartments is ruptured, said first and second components will begin to react to produce a gas pressure therein; and a quantity of said second component in a third sub-compartment next adjacent to said second sub-compartment to react with said one compartment when said first and second components in said combined first and second sub-compartments have reacted to produce sufficient gases to provide a pressure to rupture said lengthwise strip between said second and third sub-compartments to continue the generation of gas.

28. The invention according to claim 27 wherein:

said lengthwise strip between said second and third sub-compartments having a weakened portion to facilitate rupturing thereof.

29. The invention according to claim 18 wherein the nucleating agent comprises diatomaceous earth.

30. The invention according to claim 18 or 29 wherein the nucleating agent has in addition thereto an anti-caking agent and an anti-foam agent.

31. A method for producing gas in a gas pressure generation apparatus for placement within a container from which a fluid in the container is to be dispensed under pressure exerted by the apparatus, wherein the apparatus comprises a closed expandable vessel having a plurality of individual compartments formed by pressure-rupturable seal means therebetween, the method comprising:

(a) placing a first chemical compound and a nucleating agent in a first compartment, and placing a second chemical compound in a second compartment disposed adjacent the first compartment, with said first and second chemical compounds reactable with each other when mixed to produce a gas; and (b) causing the rupture of the seal means between the first and second compartments to thereby mix the first and second chemical compounds and produce gas.

32. The invention according to claim 31 wherein one chemical compound is sodium bicarbonate and the other chemical compound is citric acid.

33. The invention according to claim 32 wherein the nucleating agent is included with the sodium bicarbonate.

34. The invention according to claims 31, 32, or 33 wherein the nucleating agent comprises diatomaceous earth.

35. The invention according to claim 34 wherein the nucleating agent has in addition thereto an anti-caking agent and an anti-foam agent.

36. The invention according to claim 31 wherein the nucleating agent has in addition thereto an anti-caking agent and an anti-foam agent.

* * * * *